US005433338A

United States Patent [19]

Proshan

[11] Patent Number: 5,433,338

[45] Date of Patent: Jul. 18, 1995

[54] DEMOUNTABLE CAP FOR DISPOSABLE CONTAINERS OF LIQUID

[76] Inventor: Mary-Elizabeth Proshan, Ste. 194. 301 N. Harrison St., Princeton, N.J. 08540

[21] Appl. No.: 323,825

[22] Filed: Oct. 17, 1994

[51] Int. Cl.[6] ..... B65D 25/42; B67D 5/08

[52] U.S. Cl. ..... 220/717; 220/367.1; 222/564; 222/570

[58] Field of Search ..... 220/306, 703, 705, 711, 220/713, 714, 716, 717, 719; 222/547, 564, 566, 570, 571, 574, 567, 569

[56] References Cited

U.S. PATENT DOCUMENTS

| | | | |
|---|---|---|---|
| 4,243,156 | 1/1981 | Lobbestael | 220/717 X |
| 4,946,062 | 8/1990 | Coy | 220/714 |
| 4,949,880 | 8/1990 | Bradley | 222/564 X |
| 5,346,106 | 9/1994 | Ring | 222/564 X |

*Primary Examiner*—Allan N. Shoap
*Assistant Examiner*—Nathan J. Newhouse

[57] ABSTRACT

A cap having a flat horizontal disc having first and second openings disposed in spaced apart positions therein. The first opening is a pin hole. The second opening is rectangularly shaped and has a direction of elongation. The disc has a peripheral socket adapted to engage the periphery of the upper end of the container in such manner that liquid cannot flow out therebetween. A hollow vertical hollow spout extends upwardly from the disc with a horizontal open lower end of rectangular shape extending in said direction and coincident with said second opening. A horizontal upper open end of of the spout has a rectangular shape extending in the direction. The lower and upper ends are essentially equal in area. An inner wall of the spout extends between and isconnected to the open upper and lower ends. A flat horizontal member is disposed in and is peripherally sealed to the inner wall in a position intermediate the upper and lower ends. The member has a rectangular opening therein which extends in said direction, the area of the opening being much smaller than the area of either one of the upper and lower openings.

6 Claims, 2 Drawing Sheets

DEMOUNTABLE CAP FOR DISPOSABLE CONTAINERS OF LIQUID

CROSS REFERENCE TO COPENDING APPLICATION

The present application is related to copending application of the same inventor which is entitled REMOVABLE CAP FOR DISPOSABLE CONTAINERS OF LIQUID filed on Apr. 7, 1994, Ser. No. 08/224,159.

BACKGROUND OF THE INVENTION

Disposable containers containing cold or hot liquids are in wide use. In order to prevent the liquid from being accidently spilled during use, it is known to cover the open upper end of the container with a disposable cap having an upwardly extending drinking spout. The cap has a peripheral socket which engages the periphery of the upper end of the container.

Known caps when secured to such containers are subject to substantial and undesired leakage when a container of liquid covered with a known cap is disposed horizontally on its side or even when the container is disposed vertically and is subjected to sudden movement as for example when held in a moving vehicle so that the liquid surges upward and out ot the spout.

Copending application Ser. No. 08/224,189 is directed toward a new type of disposable cap for detachably enclosing an upper open end of a hollow vertical disposable container with liquid therein, the container having a closed lower end, which eliminates such liquid leakage problems. This cap employs a flat horizontal disc having first and second openings disposed in spaced apart positions therein. The first opening is a pin hole. The second opening is relatively large. The disc has a peripheral socket adapted to engage the periphery of the upper end of the container in such manner that liquid cannot flow out therebetween.

The cap has a hollow vertical hollow spout for delivery of the liquid. The spout tapers upwardly and outwardly from the disc and has an open lower end coincident with said second opening. The spout has an upper open end defining a first permanently open slot therein, the upper end being smaller in area than the lower end. A hollow member is disposed within the spout with an upper open end coincident with the upper end of the spout. The member has walls which are immobile with respect to each other and which extend downwardly and inwardly from the upper end of the spout to a lower end horizontally aligned with the lower end of the spout. The lower end of the member has a second permanently open slot always smaller in area than that of the first slot. Typically, the area of this second slot is less than one half the area of the first slot.

The disc, spout and member constitute a single integral unit which when positioned in place on the container will not exhibit any substantial leakage of liquid when the liquid in the container surges therein because of sudden movement of the container or when the container is disposed horizontally on its side:

The cap is formed by injection molding and displays greater structural strength than caps formed by vacuum molding. Consequently, injection molded caps can be used in applications such as soda filled containers served to children wherein vacuum molded caps can be accidently squeezed and collapse.

Since the lower end of the member is horizontally aligned with the lower end of the spout, these caps cannot be stacked one above another with the spout of the lower cap extending partially within the spout of the upper cap.

However, it is relatively expensive to form the member with walls which are immobile with respect to each other and which extend downwardly and inwardly from the upper end of the spout to a lower end horizontally aligned with the lower end of the spout.

The present invention provides an injection molded cap having the same advantages of the cap disclosed in the aforementioned application but differs in geometry and can be manufactured less expensively.

SUMMARY OF THE INVENTION

In accordance with the principles of this invention, an injection molded cap is adapted to detachably enclose an upper open end of a hollow vertical disposable container with liquid therein, the container having a closed lower end. The cap employs a flat horizontal disc having first and second openings disposed in spaced apart positions therein. The first opening is a pin hole. The second opening is relatively large and has the shape of a rectangle. The disc has a peripheral socket adapted to engage the periphery of the upper end of the container in such manner that liquid cannot flow out therebetween.

The cap has a hollow vertical hollow spout for delivery of liquid. The spout extends upwardly from the disc. The spout has a vertical straight inner wall which extends between an open horizontal upper end and an open horizontal lower end. Both open ends are rectangularly shaped and extend in the same direction of elongation. The lower end is coincident with said second opening. A thin flat horizontal member is disposed within the spout in the lower half of the inner wall parallel to the opposite ends of the inner wall and peripherally sealed to the inner wall. The member contains a rectangular slot which is much smaller in area than either the upper or lower open end of the spout and extends in the same direction of elongation. Typically, the area of the slot is less than one eighth of the area of either of the open ends of the inner wall of the spout.

The disc, spout and member constitute a single integral unit which when positioned in place on the container will not exhibit any substantial leakage of liquid when the liquid in the container surges therein because of sudden movement of the container or when the container is disposed horizontally.

DETAILED DESCRIPTION OF PREFERRED EMBODIMENT

Figure 1:
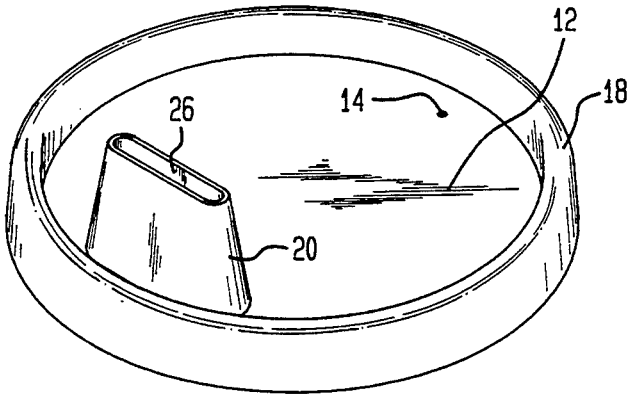
FIG. 1 is a top perspective view of a preferred embodiment of the invention.
Figure 2:
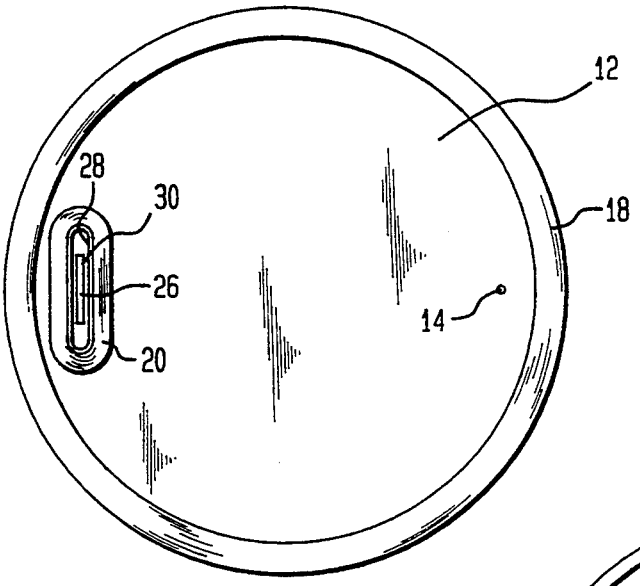
FIG. 2 is a top plan view thereof.
Figure 3:
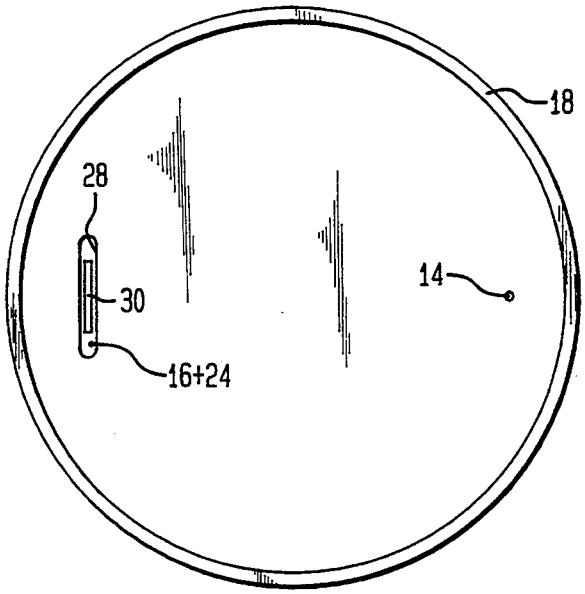
FIG. 3 is a bottom plan view thereof.
Figure 4:
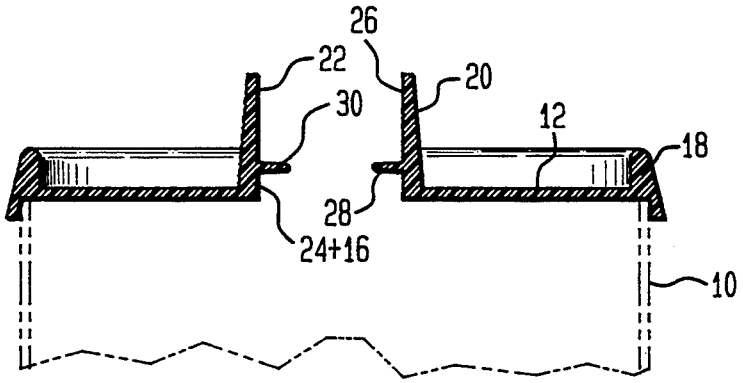
FIG. 4 is a vertical cross sectional view thereof as taken at right angles to the width of the spout.
Figure 5:
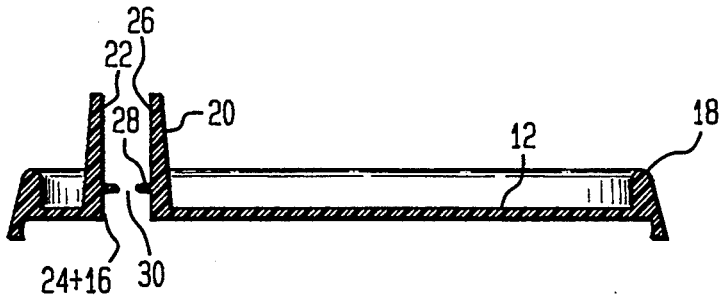
FIG. 5 is a vertical cross sectional view thereof as taken at right angles to the cross sectional view shown in FIG. 4.

Referring now to FIGS. 1–5, there is shown a cap for detachably enclosing an upper open end 10 of a hollow vertical disposable container with liquid therein. The container has a closed lower end.

The cap employs a flat horizontal disc 12 having first and second openings 14 and 16 disposed in spaced apart positions therein. The first opening 14 is a pin hole and is used to establish a path for air to escape when the cap is positioned on a container filled with liquid as well as enabling air to enter the container as the liquid is consumed and its level is reduced. The second opening 16 is relatively large and is rectangular in shape.

The disc has a peripheral socket 18 adapted to engage the periphery of the upper end of the container so tightly that liquid cannot flow out therebetween.

A hollow vertical spout 20 for delivery of the liquid extends upwardly and outwardly from the disc. The spout has a straight vertical inner wall 22 with an open horizontal lower end 24 coincident with said second opening 16. The inner wall has an open horizontal upper end defining a rectangular opening 26 in the upper end of the spout. The areas of the open ends 24 and 26 are equal and these ends have the same shape. Both ends extend in the same direction of elongation.

A thin flat horizontal member 28 is disposed in the lower half of the inner wall 22 and is peripherally sealed thereto. Member 28 has a small rectangular opening 30 which is centered therein and extends in the same direction as the ends 24 and 26, the member being parallel to these ends. The area of the opening 30 is much smaller than the area of either end, generally being no more than one eighth as large and typically being about one sixteenth as large.

The disc, spout and member constitute a single integral unit which when positioned in place on the container will not exhibit any substantial leakage of liquid when the liquid in the container surges therein because of sudden movement of the container or when the container is disposed horizontally on its side. More particularly, the leakage is limited to one or two drops of liquid.

The material used in injection molding is, typically, polystyrene.

Illustrative dimensions of the preferred embodiment are as follows. The inner diameter of the disc which extends to the inner edge of the socket is 3 and $\frac{1}{8}$ inches, while the diameter which extends to the outer edge of the socket is 3 and $\frac{1}{4}$ inches. The disc is 1/16 inch thick.

The spout is $\frac{5}{8}$ inches high as measured from the plane of the disc, is 13/16 inches long and 3/16 inch wide as measured at its top, and is $\frac{7}{8}$ inches long and 5/16 inches wide as measured at its bottom. The upper open end is $\frac{3}{4}$ inches long and $\frac{1}{8}$ inch wide. The lower open end, which is coincident with the second opening, is also $\frac{3}{4}$ inches long and $\frac{1}{8}$ inch wide. The inner wall of the spout is $\frac{3}{4}$ inch deep.

The member 28 is 1/16 inch thick. The top surface of the member 28 is disposed 7/16 inch below the open upper end. The rectangular opening in the member, which is centered therein, is 5/16 inch long and 1/32 inch wide.

The inner side of the socket has a maximum height of 3/16 inches above the disc and the outer side of the socket is 5/16 inches in length and extends 2/16 inches below the disc. The socket is 2/16 inches thick.

The spout is disposed off center in the disc and can have an outer edge coincident with the inner side of the socket if desired.

While the invention has been described with particular reference to the preferred embodiment and the drawings, the protection sought is to be limited only by the terms of the claims which follow.

What is claimed is:

1. A cap for detachably enclosing an upper open end of a hollow vertical disposable container with liquid therein, the container having a closed lower end, said cap comprising:

a flat horizontal disc having first and second openings disposed in spaced apart positions therein, the first opening being a pin hole, the second opening being rectangularly shaped and having a direction of elongation, the disc having a peripheral socket adapted to engage the periphery of the upper end of the container in such manner that liquid cannot flow out therebetween;

a hollow vertical spout for delivery of said liquid, said spout extending upwardly from the disc and having a horizontal open lower end of rectangular shape extending in said direction and coincident with said second opening, the spout having a horizontal upper open end of rectangular shape extending in said direction, the lower and upper ends being essentially equal in area, the spout having an inner wall extending between and connected to the open upper and lower ends;

a flat horizontal member disposed in and peripherally sealed to the inner wall in a position intermediate the upper and lower ends, the member having a rectangular opening therein which extends in said direction, the area of the opening being much smaller than the area of either one of the upper and lower openings;

the disc, spout and member constituting a single integral unit which when positioned in place on the container will not exhibit any substantial leakage of liquid when the liquid in the container surges therein because of sudden movement of the container or when the container is disposed horizontally on its side.

2. The cap of claim 1 wherein the rectangular opening is centered in the member.

3. The cap of claim 2 wherein the inner wall is straight and vertical.

4. The cap of claim 3 wherein the inner wall has an upper half and a lower half and the member is disposed in the lower half.

5. The cap of claim 4 wherein the area of the opening is no larger than $\frac{1}{8}$ of the area of either one of the upper and lower ends.

6. The cap of claim 5 wherein the single integral unit is injection molded.

* * * * *